US005735677A

United States Patent [19]

Miura et al.

[11] Patent Number: 5,735,677

[45] Date of Patent: Apr. 7, 1998

[54] SCROLL TYPE FLUID MACHINE HAVING RECESSES ON THE SWIVEL SCROLL END PLATE

[75] Inventors: Shigeki Miura; Mikihiko Ishii, both of Nishi-Kasugai-gun; Masahiro Fukushima, Nagoya, all of Japan

[73] Assignee: Mitsubishi Jukogyo Kabushiki Kaisha, Tokyo, Japan

[21] Appl. No.: 662,611

[22] Filed: Jun. 13, 1996

[30] Foreign Application Priority Data

Jul. 13, 1995 [JP] Japan ..... 7-200423

[51] Int. Cl.[6] ..... F01C 1/04

[52] U.S. Cl. ..... 418/55.2

[58] Field of Search ..... 418/55.1, 55.2, 418/55.3

[56] References Cited

U.S. PATENT DOCUMENTS 4,795,323 1/1989 Lessie ..... 418/55.3

5,188,520 2/1993 Nakamura et al. ..... 418/55.1

FOREIGN PATENT DOCUMENTS 0 623 733 11/1994 European Pat. Off. .

OTHER PUBLICATIONS

Patent Abstracts of Japan, vol. 17, No. 12 (M-1351), Jan. 11, 1993.

*Primary Examiner*—John J. Vrablik

*Attorney, Agent, or Firm*—Wenderoth, Lind & Ponack

[57] ABSTRACT

A scroll type fluid machine has a stationary scroll 1 and a swivel scroll 2 engaged therewith contained within a hermetic housing 4. A plurality of legs 15 are provided on the outer circumferential edge of an end plate 11 of the stationary scroll 1, and are fixed by bolts 64 to a frame 5 supporting a rotating shaft 3 via a bearing 52. A rotation prevention mechanism 6 is interposed between the frame 5 and the swivel scroll 2. The swivel scroll 2 is connected to the rotating shaft 3 so as to make revolutional swivel motions. The diameter of the end plate 11 of the stationary scroll 1 is shortened, and thereby the hermetic housing 4 is made smaller. A cut out recess portion 25 is provided at each position corresponding to the plurality of legs 15 of the outer circumferential portion of a circular end plate 21 of the swivel scroll 2.

9 Claims, 3 Drawing Sheets

SCROLL TYPE FLUID MACHINE HAVING RECESSES ON THE SWIVEL SCROLL END PLATE

BACKGROUND OF THE INVENTION

1. Field of the Invention

The present invention relates to a scroll type fluid machine to be used as a compressor or an expander.

2. Description of the Prior Art

One example of a conventional scroll type compressor is shown in FIG. 2 and FIG. 3. In FIG. 2, numeral 4 designates a hermetic housing consisting of a cup-like right hand housing 49, a frame 5 and a cup-like left hand housing 43, and all these components are connected to one another by bolts 56. Within the right hand housing 49, an electric motor M is disposed, and within the left hand housing 43, a scroll type compression mechanism C is disposed, respectively.

The electric motor M and the scroll type compression mechanism C are connected to each other via a rotating shaft 3.

The right hand end of the rotating shaft 3 is rotatably supported by the right hand housing 49 via a sub-bearing 51, and the left hand end of same is rotatably supported by the frame 5 via a main bearing 52.

The electric motor M consists of a rotor Ma and a stator Mb, and the rotor Ma is fixed to the rotating shaft 3 and the stator Mb is fixed to the right hand housing 49 by means of press fitting.

The scroll type compression mechanism C consists of a stationary scroll 1, a swivel scroll 2, a rotation prevention mechanism 6, e.g. of an Oldham link etc. to prevent rotation of the swivel scroll 2, etc.

The stationary scroll 1 comprises an end plate 11 and a spiral wrap 12 provided standing on the inner surface of the end plate. By the outer circumferential surface of the end plate 11 being sealingly contacted with the inner circumferential surface of the left hand housing 43, a discharge chamber 46 is formed on the left hand side of the end plate 11 and a suction chamber 47 is defined on the right hand side of same. At the center portion of the end plate 11, a discharge port 13 is provided so that this discharge port 13 is opened and closed by a discharge valve 17.

The swivel scroll 2 comprises an end plate 21 and a spiral wrap 22 provided standing on the inner surface of the end plate. Within a boss 23 provided standing on the outer surface of the end plate 21, a drive bush 32 is rotatably fitted in via a swivel bearing 34. Within a slide groove 33 in the drive bush 32, an eccentric drive pin 31 projecting from the left hand end of the rotating shaft 3 is slidably fitted.

The stationary scroll 1 and the swivel scroll 2 are engaged with each other with an eccentricity of a predetermined distance and with a deviation angle of 180 degrees, and thereby a plurality of closed cavities 24 are formed.

Upon the electric motor M being driven, the swivel scroll 2 is driven via a swivel drive mechanism consisting of the rotating shaft 3, the eccentric drive pin 31, the drive bush 32, the boss 23, etc., and the swivel scroll 2, while being prevented from rotating by the rotation prevention mechanism 6, makes revolutional swivel motions on a circular track of a revolutional swivel radius.

Thereupon, gas enters a low pressure chamber 48 through a suction port 44. The gas, while it passes through a passage 58 provided around the outer circumference of the stator Mb and through a gap 59 between the stator Mb and the rotor Ma, cools the electric motor M. It is then sucked into the closed cavities 24 through a passage 54 provided in the frame 5 and through the suction chamber 47.

Then, with the volumes of the closed cavities 24 being reduced by the revolutional swivel motions of the swivel scroll 2, the gas moves to the central portion as it is compressed, passes the central portion and the discharge port 13, forcibly opens the discharge valve 17 to be discharged into the discharge chamber 46 and then flows to the outside through a discharge port 45.

Incidentally, numeral 18 designates a valve stop member limiting the opening of the discharge valve 17. The valve stop member is fixed together with the discharge valve 17 to the outer surface of the end plate 11 of the stationary scroll 1. Numeral 62 designates a glass terminal, and electric power is supplied to the stator Mb of the electrical motor M via the glass terminal 62. Numeral 35 designates a balance weight fixed to the rotating shaft 3.

In the conventional scroll type compressor as mentioned above, as shown in FIG. 3, the end plate 21 of the swivel scroll 2 is formed to be circular. A plurality of legs 15 (four legs in the figure) projecting in the right hand direction from the outer circumferential edge of the end plate 11 of the stationary scroll 1 are provided so as not to touch the end plate 21. The legs 15 are fixed to the frame 5 by bolts 64. Thus there is a problem in that the diameter of the end plate 11 of the stationary scroll 1 becomes larger and, accompanying therewith, the diameter of the hermetic housing 4 also becomes larger.

SUMMARY OF THE INVENTION

In order to resolve the above-mentioned problem in the prior art, the present invention has a cut out recess portion provided at each position, corresponding to the plurality of legs, of the outer circumferential portion of the circular end plate of the swivel scroll. Thus when the swivel scroll makes revolutional swivel motions, the plurality of legs of the stationary scroll make relative movements within each cut out recess portion so as not to interfere with the end plate of the swivel scroll.

BRIEF DESCRIPTION OF THE DRAWINGS

In the accompanying drawings:

FIG. 1 shows a scroll type compressor of one preferred embodiment according to the present invention, wherein

DESCRIPTION OF THE PREFERRED EMBODIMENTS

Figure 1A:
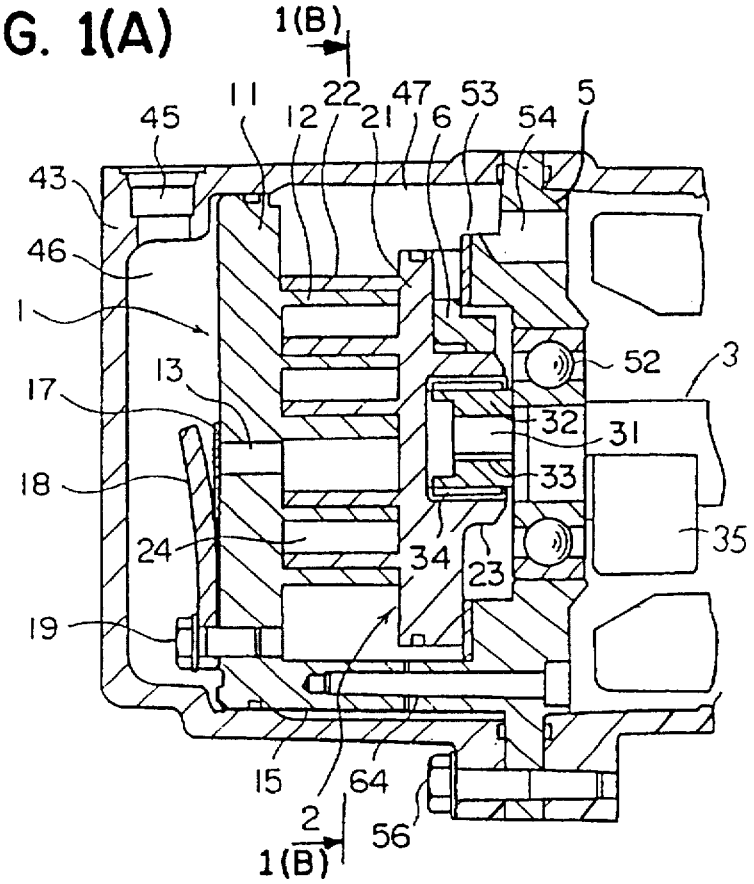
FIG. 1(A) is a partial longitudinal sectional view taken along line 1(A)—1(A) of FIG. 1(B) and FIG. 1(B) is a transverse sectional view taken along line 1(B)—1(B) of FIG. 1(A)
Figure 1B:
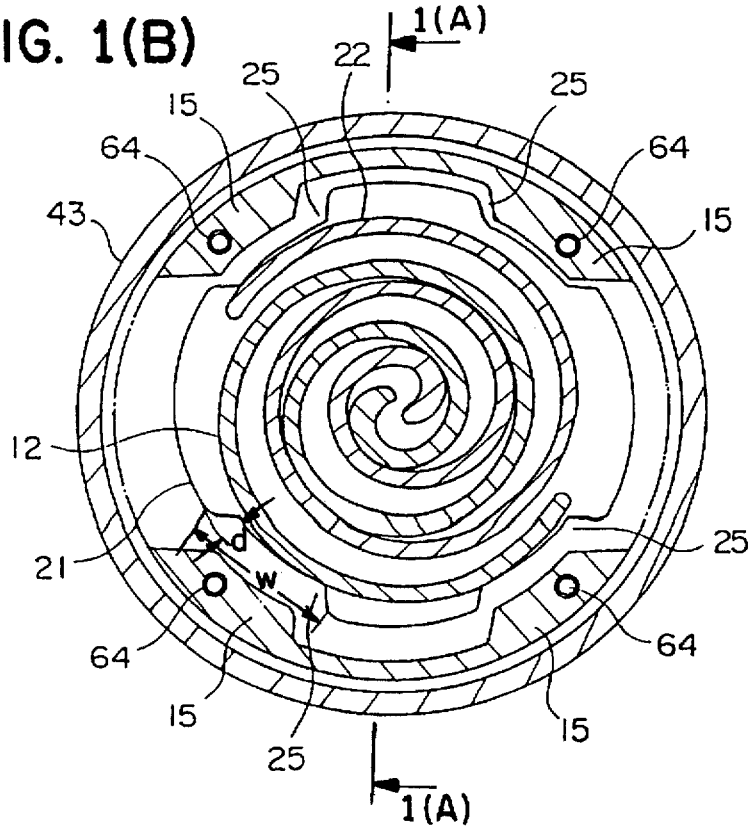

One preferred embodiment according to the present invention is shown in FIG. 1. As shown in FIG. 1(B), a cut out recess portion is formed at each position, corresponding to a plurality of legs 15 of the stationary scroll, of the outer circumferential portion of a circular end plate 21 of a swivel scroll 2.

The cut out recess portion 25 is of a shape having a sufficient depth d and width w that the end plate 11 of the swivel scroll 2 does not interfere with the legs 15 when the swivel scroll 2 makes revolutional swivel motions.

Figure 2:
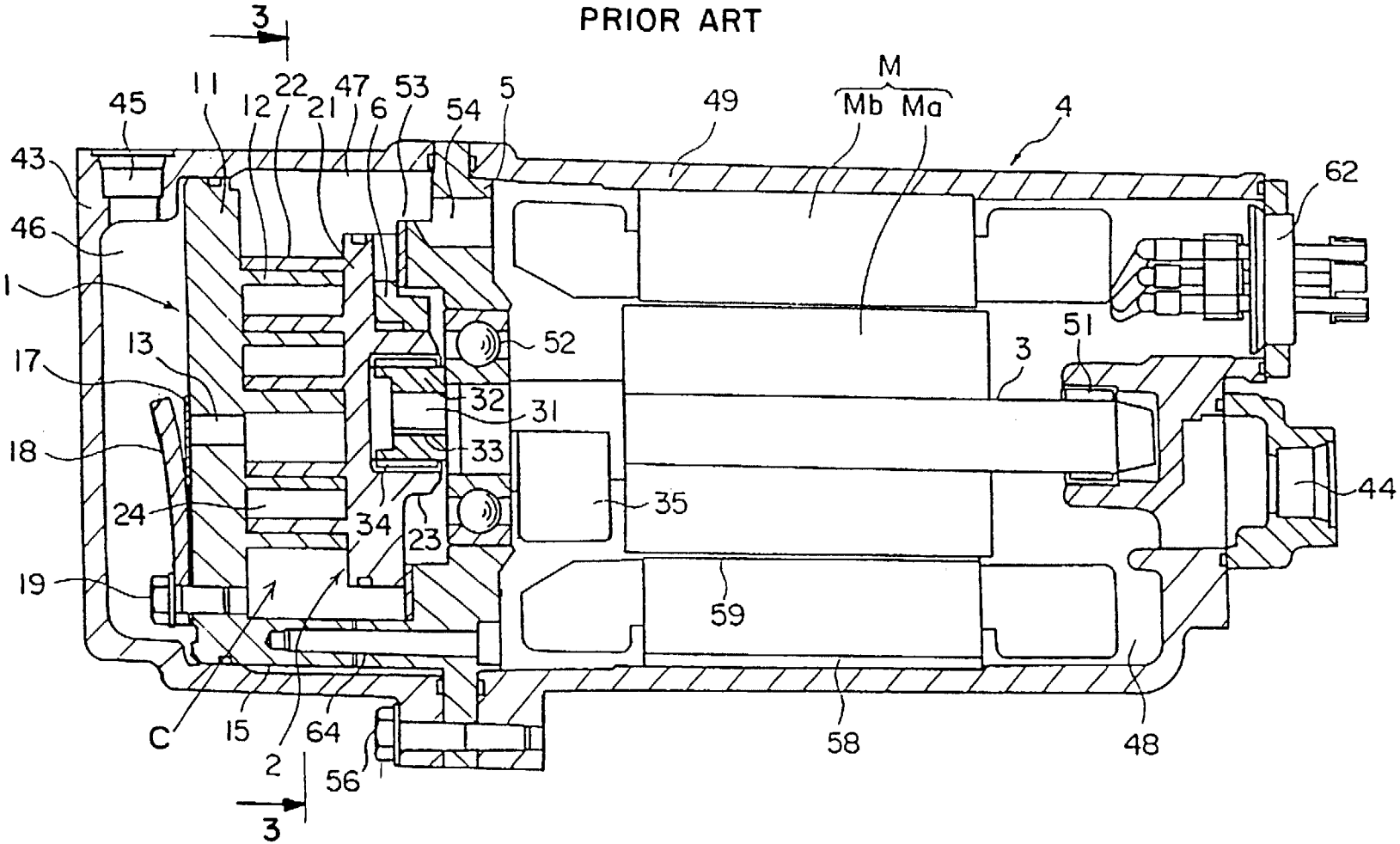
FIG. 2 PRIOR ART
FIG. 2 is a longitudinal sectional view of a scroll type compressor in the prior art.
Figure 3:
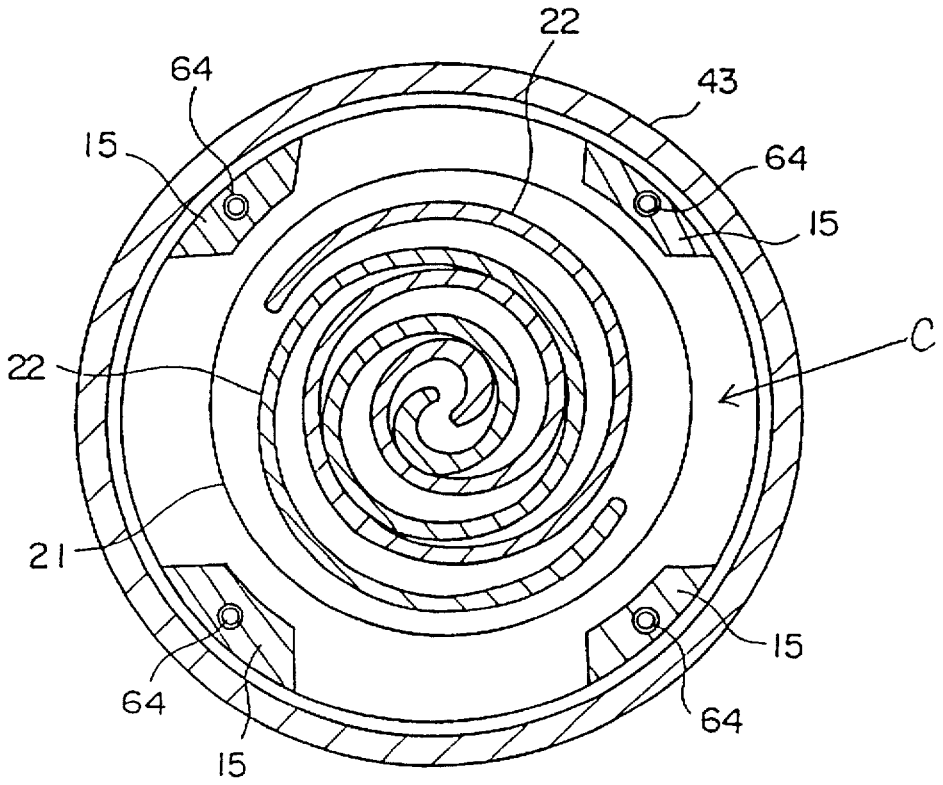
FIG. 3 PRIOR ART
FIG. 3 is a transverse sectional view taken along line 3—3 of FIG. 2.

The remaining features are same as those of the conventional embodiment shown in FIGS. 2 and 3, corresponding components and parts are given the same reference numerals, and further description is omitted.

When the swivel scroll 2 makes revolutional swivel motions, the legs 15 of the stationary scroll 1 make relative movements within each cut out recess portion 25 so as not to interfere with the end plate 21 of the swivel scroll 2. Accordingly, the fitting position of the legs 15 of the stationary scroll 1 can be moved in the centripetal direction by a length corresponding to the depth d of the cut out recess portion 25. As a result the diameter of the end plate 11 of the stationary scroll 1 can be shortened by the same length and the diameter of the hermetic housing 4 can be made smaller.

According to the present invention, as a cut out recess portion is provided at each position, corresponding to the plurality of legs of the stationary scroll, of the outer circumferential portion of the circular end plate 21 of the swivel scroll, the legs of the stationary scroll do not interfere with the end plate of the swivel scroll when the swivel scroll makes revolutional swivel motions.

Thus, the fitting position of the legs of the stationary scroll can be moved in the centripetal direction by a length corresponding to the depth of the cut out recess portion. As a result the diameter of the end plate of the stationary scroll can be shortened by the same length and the diameter of the hermetic housing can be made smaller.

While the preferred form of the present invention has been described, variations thereto will occur to those skilled in the art within the scope of the present inventive concepts which are delineated by the following claims.

What is claimed is:

1. An arrangement in a scroll type fluid machine, comprising:

a sealed housing;

a frame in said sealed housing supporting a rotating shaft via a bearing;

a stationary scroll in said housing, said stationary scroll comprising an end plate;

a plurality of legs on an outer circumferential edge of said end plate of said stationary scroll fixed to said frame by bolts;

a swivel scroll in said housing engaged with said stationary scroll, said swivel scroll having a circular end plate having an outer circumferential portion and a swivel wrap, and said swivel scroll being connected with said rotating shaft so as to be able to make revolutional swivel motions upon rotation of said shaft, said swivel scroll having a swivel center;

a rotation prevention mechanism interposed between said frame and said swivel scroll; and a plurality of cut out recess portions on said outer circumferential portion of said circular end plate of said swivel scroll located at positions corresponding to and receiving respective ones of said plurality of legs, each of said cut out recess portions having a shape having a depth and width so as to avoid interference with the respective one of said plurality of legs upon said swivel scroll undergoing revolutional swivel motions.

2. The scroll type fluid machine of claim 1, wherein said rotation prevention mechanism comprises an Oldham ring.

3. An arrangement in a scroll type fluid machine, comprising:

a sealed housing;

a frame in said sealed housing supporting a rotating shaft via a bearing;

a stationary scroll in said housing, said stationary scroll comprising an end plate;

a plurality of legs on an outer circumferential edge of said end plate of said stationary scroll fixed to said frame by bolts;

a swivel scroll in said housing engaged with said stationary scroll, said swivel scroll having a circular end plate having an outer circumferential portion and a swivel wrap, and said swivel scroll being connected with said rotating shaft so as to be able to make revolutional swivel motions upon rotation of said shaft, said swivel scroll having a swivel center;

a rotation prevention mechanism interposed between said frame and said swivel scroll; and a plurality of cut out recess portions on said outer circumferential portion of said circular end plate of said swivel scroll located at positions corresponding to respective ones of said plurality of legs, each of said cut out recess portions having a shape having a depth and width sufficient to avoid interference with the respective one of said plurality of legs upon said swivel scroll undergoing revolutional swivel motions, and the depth of each of said plurality of cut out recess portions being such as to extend to an imaginary circle defined by a radius formed by the line between the swivel center of said swivel scroll and an outermost end of said swivel wrap.

4. The scroll type fluid machine of claim 3, wherein said rotation prevention mechanism comprises an Oldham ring.

5. A scroll type fluid machine, comprising:

a sealed housing comprising a pair of cup-shaped housing portions, each of said cup-shaped housing portions having an open end side having a clamping flange thereat and each of said cup-shaped housing being joined to the other of said cup-shaped housings by said clamping flange;

a frame having an outer circumferential flange, said frame being fixed in said sealed housing by having said outer circumferential flange interposed between said clamping flanges of said pair of cup-shaped housing portions;

a rotating shaft rotatably supported by said frame;

an electric motor contained within one of said cup-shaped housing portions of said sealed housing and connected with one end of said rotating shaft;

a stationary scroll in the other one of said cup-shaped housing portions of said sealed housing, said stationary scroll comprising an end plate;

a plurality of legs extending axially from an outer circumferential edge of said end plate of said stationary scroll and fixed to said frame by bolts;

a swivel scroll engaged with said stationary scroll and supported in a direction of thrust by said frame, said swivel scroll having a circular end plate having an outer circumferential portion and a swivel wrap, and said swivel scroll being connected with the other end of said rotating shaft so as to be able to make revolutional swivel motions upon rotation of said shaft, said swivel scroll having a swivel center;

a rotation prevention mechanism interposed between said frame and said swivel scroll; and a plurality of cut out recess portions on said outer circumferential portion of said circular end plate of said swivel scroll located at positions corresponding to respective ones of said plurality of legs, each of said cut out recess portions having a shape having a depth and width sufficient to avoid interference with the respective one of said plurality of legs upon said swivel scroll undergoing revolutional swivel motions, and the depth of each of said plurality of cut out recess portions being such as to extend to an imaginary circle defined by a radius formed by the line between the swivel center of said swivel scroll and an outermost end of said swivel wrap.

6. The scroll type fluid machine of claim 5, wherein one of said plurality of legs has a substantially trapezoidal sectional shape in which the width of said shape becomes narrower in the direction of a central axis of said sealed housing, and the corresponding said recess of said circular end plate of said swivel scroll has a substantially trapezoidal shape in which the width thereof becomes wider in the direction away from the central axis so as to correspond to the trapezoidal sectional shape of the one of said plurality of legs.

7. The scroll type fluid machine of claim 5, wherein said plurality of legs are located at four places equally spaced about the circumference of said end plate of said stationary scroll.

8. The scroll type fluid machine of claim 5, wherein said bolts extend from an end face of said frame on a side of said frame opposite to stationary scroll so as to fix said stationary scroll to said frame.

9. The scroll type fluid machine of claim 5, wherein said rotation prevention mechanism comprises an Oldham ring.

* * * * *